US005727858A

United States Patent [19]

Shapiro

[11] Patent Number: 5,727,858

[45] Date of Patent: Mar. 17, 1998

[54] UNIVERSAL DRAWER HANDLE

[76] Inventor: Alan Shapiro, 186 E. Nassau St., Islip Terrace, N.Y. 11752-2908

[21] Appl. No.: 623,904

[22] Filed: Mar. 27, 1996

[51] Int. Cl.[6] ..... A47B 95/02

[52] U.S. Cl. ..... 312/348.6; 16/124; 16/DIG. 24; 403/362

[58] Field of Search ..... 312/244, 348.6; 16/124, 110 R, 114 R, DIG. 24; 220/755; 403/362, 381

[56] References Cited

U.S. PATENT DOCUMENTS

| | | | |
|---|---|---|---|
| Re. 22,807 | 10/1946 | Bechik | 16/125 |
| 2,498,139 | 2/1950 | Simjian | 16/110 R X |
| 2,696,419 | 12/1954 | Wallance et al. | 312/265.3 |
| 2,852,114 | 9/1958 | Heit | 16/114 R |
| 3,109,687 | 11/1963 | Dereng | 312/244 |
| 3,589,788 | 6/1971 | Kaiden | 312/265.1 |
| 4,087,141 | 5/1978 | Roberts | 312/348.6 |
| 4,138,094 | 2/1979 | Thir | 403/381 X |
| 4,524,483 | 6/1985 | Lynham . | |
| 5,127,131 | 7/1992 | Corrigan . | |
| 5,231,733 | 8/1993 | Dittman . | |
| 5,242,769 | 9/1993 | Cole . | |
| 5,335,890 | 8/1994 | Pryor . | |
| 5,373,608 | 12/1994 | Welch . | |

FOREIGN PATENT DOCUMENTS

| | | | |
|---|---|---|---|
| 1387217 | 12/1964 | France | 16/110 R |

*Primary Examiner*—Peter M. Cuomo
*Assistant Examiner*—Janet M. Wilkens

[57] ABSTRACT

A universal drawer handle that includes a pair screws a pair of post portions, and a handle portion. The pair of post portions, are removably mounted to a conventional drawer front of a conventional drawer by the pair of mounting screws that have free ends that pass through a pair of conventional handle mounting holes in the conventional drawer front of the conventional drawer. The handle portion is slidably mounted to any desired position on the pair of post portions, so that the handle portion is free to slide relative to the pair of post portions and adjust for different spacings between different pairs of conventional handle mounting holes of different conventional drawer fronts of different conventional drawers so as to allow the universal drawer handle to be used to replace different sized drawer handles. And, the pair of mounting screws are tightened until the free ends of the pair of mounting screws exert a force on the handle portion when the desired position of the handle portion has been achieved, so that the handle portion is secured to the pair of post portions and prevented from lateral movement relative thereto while the pair of post portions is secured between the conventional drawer front of the conventional drawer and the handle portion.

27 Claims, 6 Drawing Sheets

UNIVERSAL DRAWER HANDLE

BACKGROUND OF THE INVENTION

The present invention relates to a drawer handle. More particularly, the present invention relates to a universal drawer handle that includes a pair of screws, a pair of post portions that are removably mounted to a conventional drawer front of a conventional drawer by the pair of mounting screws that pass through the conventional handle mounting holes in the conventional drawer front of the conventional drawer, and a handle portion that is slidably mounted to the pair of post portions, so that the handle portion is free to slide relative to the pair of post portions and adjust for different spacings between the conventional handle mounting holes of different conventional drawer fronts of different conventional drawers.

Furniture, such as for example, desks, computer furniture, wardrobes, cupboards, chests of drawers, and cabinets, etc. are well known and are presently used in the majority of homes and offices. The furniture has handles for enabling doors and/or drawers to be opened and closed.

Sometimes it becomes necessary, however, to replace the existing handles with new ones. Rigid replacement handles are known and they are made in different sizes to fit differing distances between the existing screw holes in the doors and drawers of the furniture.

Persons needing to replace handles on their furniture do not wish to incur the trouble of drilling new handle holes to receive the screws for the replacement handle. Further, with furniture materials such as chipboard new handle holes can not be drilled too close to existing handle holes as crumbling of the material occurs and then it becomes impossible to correctly fit the replacement handle, while metal furniture is difficult to drill.

Numerous innovations for handles have been provided in the prior art that will be described. Even though these innovations may be suitable for the specific individual purposes to which they address, they differ from the present invention in that they do not teach a universal drawer handle that includes a pair of screws a pair of post portions that are removably mounted to the conventional drawer front of a conventional drawer by the pair of mounting screws that pass through the conventional handle mounting holes in the conventional drawer front of the conventional drawer, and a handle portion that is slidably mounted to the pair of post portions, so that the handle portion is are free to slide relative to the pair of post portions and adjust for different spacings between the conventional handle mounting holes of different conventional drawer fronts of different conventional drawers.

FOR EXAMPLE, U.S. Pat. No. Re. 22,807 to Bechik teaches a flexible mattress handle that includes a flexible material provided at each end with anchoring means which extend through grommets in the wall of the mattress and are anchored on the inner wall surface.

ANOTHER EXAMPLE, U.S. Pat. No. 2,852,114 to Heit teaches a handbag and luggage handle that includes a shell member and a plastic covering material that is tightly wrapped against and abuts the shell member while being secured thereto without stitching.

STILL ANOTHER EXAMPLE, U.S. Pat. No. 4,524,483 to Lynham et al. teaches an adjustable length flexible handle that includes a hollow elongated and flexible body, a pair of end collar members each of which being slidably fit over each end portion of the hollow elongated and flexible body, and a pair of screw members for screwing one into each end portion of the body to secure the body to the door with the pair of end collar members abutting the door.

YET ANOTHER EXAMPLE, U.S. Pat. No. 5,127,131 to Corrigan et al. teaches a removable hand hold that includes two different mounting brackets that are permanently fastened to a supporting structure, a slide plate disposed at one end of the hand hold which mates with one of the mounting brackets, and a securing member disposed at the opposite end of the hand hold which connects with the other mounting bracket by means of a locking device.

STILL YET ANOTHER EXAMPLE, U.S. Pat. No. 5,231,733 to Dirtman teaches an aid for grasping round knobs that includes a generally dome-shaped grasping element having a handle attached thereto and extending outwardly therefrom. The internal surface of the generally dome-shaped grasping has a series of internal shoulders of various sizes.

YET STILL ANOTHER EXAMPLE, U.S. Pat. No. 5,242,769 to Cole et al. teaches a battery carrying handle that includes a pair of channels that are disposed on the battery casing, a pair of projecting members slidably engagable with the channels and being disposed on the battery handle, and limiting means for limiting the amount of travel of the pair of projecting members in the pair of channels.

STILL YET ANOTHER EXAMPLE, U.S. Pat. No. 5,335,890 to Pryor et al. teaches a ceiling track mounting apparatus that includes a sliding channel member for sliding engagement with an overhead track and a clip device secured to the upper wall of the channel member for engaging over a ceiling tee-bar.

FINALLY, YET STILL ANOTHER EXAMPLE, U.S. Pat. No. 5,373,608 to Welch teaches a cooking vessel that includes a handle that is engaged with a vessel through the use of a channel mounted on the end of the handle which mates with a rail mounted on the vessel.

It is apparent that numerous innovations for handles have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY AN OBJECT of the present invention is to provide a universal drawer handle that avoids the disadvantages of the prior art.

ANOTHER OBJECT of the present invention is to provide a universal drawer handle that is simple and inexpensive to manufacture.

STILL ANOTHER OBJECT of the present invention is to provide a universal drawer handle that is simple to use.

BRIEFLY STATED, YET ANOTHER OBJECT of the present invention is to provide a universal drawer handle that includes a pair of screws, a pair of post portions, and a handle portion.

STILL YET ANOTHER OBJECT of the present invention is to provide a universal drawer handle wherein the pair of post portions are removably mounted to a conventional drawer front of a conventional drawer by the pair of mounting screws that have free ends that pass through a pair of conventional handle mounting holes in the conventional drawer front of the conventional drawer.

YET STILL ANOTHER OBJECT of the present invention is to provide a universal drawer handle wherein the handle portion is slidably mounted to any desired position on the pair of post portions, so that the handle portion is free to slide relative to the pair of post portions and adjust for different spacings between different pairs of conventional handle mounting holes of different conventional drawer fronts of different conventional drawers so as to allow the universal drawer handle to be used to replace different sized drawer handles.

STILL YET ANOTHER OBJECT of the present invention is to provide a universal drawer handle wherein the pair of mounting screws are tightened until the free ends of the pair of mounting screws exert a force on the handle portion when the desired position of the handle portion has been achieved, so that the handle portion is secured to the pair of post portions and prevented from lateral movement relative thereto while the pair of post portions are secured between the conventional drawer front of the conventional drawer and the handle portion.

YET STILL ANOTHER OBJECT of the present invention is to provide a universal drawer handle wherein the pair of post portions and the handle portion are selected from the group consisting of wood, plastic, and metal.

STILL YET ANOTHER OBJECT of the present invention is to provide a universal drawer handle wherein the handle portion has an elongated, generally rectangular-parallelepiped-shaped, and open-ended body with open ends, a generally rectangular-shaped rear face, and a longitudinal axis.

YET STILL ANOTHER OBJECT of the present invention is to provide a universal drawer handle wherein the elongated, generally rectangular-parallelepiped-shaped, and open-ended body further has a longitudinally-oriented and generally T-shaped track channel that extends longitudinally through the elongated, generally rectangular-parallelepiped-shaped, and open-ended body and opens into the open ends of the elongated, generally rectangular-parallelepiped-shaped, and open-ended body.

STILL YET ANOTHER OBJECT of the present invention is to provide a universal drawer handle wherein the longitudinally-oriented and generally T-shaped track channel of the elongated, generally rectangular-parallelepiped-shaped, and open-ended body has a portion that opens into the generally rectangular-shaped rear face of the elongated and generally rectangular-parallelepiped-shaped body.

YET STILL ANOTHER OBJECT of the present invention is to provide a universal drawer handle wherein the handle portion has an elongated, generally cylindrically-shaped, and open-ended body with open ends, a generally arcuate-shaped rear face, and a longitudinal axis.

STILL YET ANOTHER OBJECT of the present invention is to provide a universal drawer handle wherein the elongated, generally cylindrically-shaped, and open-ended body further has a longitudinally-oriented and generally T-shaped track channel that extends longitudinally through the elongated, generally cylindrically-shaped, and open-ended body and opens into the open ends of the elongated, generally cylindrically-shaped, and open-ended body.

YET STILL ANOTHER OBJECT of the present invention is to provide a universal drawer handle wherein the longitudinally-oriented and generally T-shaped track channel of the elongated, generally cylindrically-shaped, and open-ended body has a portion that opens into the generally arcuate-shaped rear face of the elongated and generally cylindrically-shaped body.

STILL YET ANOTHER OBJECT Of the present invention is to provide a universal drawer handle wherein each of the pair of post portions has a generally rectangular-parallelepiped-shaped body with a generally rectangular-shaped proximal face, a generally rectangular-shaped distal face, a longitudinal axis, and a centrally-and-longitudinally-disposed throughbore that extends along the longitudinal axis of the generally rectangular-parallelepiped-shaped body from the generally rectangular-shaped proximal face of the generally rectangular-parallelepiped-shaped body to the generally rectangular-shaped distal face of the generally rectangular-parallelepiped-shaped body and into which a respective one of the pair of mounting screws enters.

YET STILL ANOTHER OBJECT of the present invention is to provide a universal drawer handle wherein the generally rectangular-parallelepiped-shaped body is divided laterally into a generally rectangular-parallelepiped-shaped main portion and a generally rectangular-parallelepiped-shaped head portion by a pair of laterally-oriented, opposingly aligned, and generally rectangular-parallelepiped-shaped grooves.

STILL YET ANOTHER OBJECT of the present invention is to provide a universal drawer handle wherein the pair of laterally-oriented, opposingly aligned, and generally rectangular-parallelepiped-shaped grooves of the generally rectangular-parallelepiped-shaped body are in opposing alignment to each other and extend laterally across the generally rectangular-parallelepiped-shaped body in proximity to the generally rectangular-shaped distal face of the generally rectangular-parallelepiped-shaped body.

YET STILL ANOTHER OBJECT of the present invention is to provide a universal drawer handle wherein the generally rectangular-parallelepiped-shaped head portion of the generally rectangular-parallelepiped-shaped body is slidably mounted in the longitudinally-oriented and generally T-shaped track channel of the handle portion.

STILL YET ANOTHER OBJECT of the present invention is to provide a universal drawer handle wherein each of the pair of post portions has a generally T-shaped body with a generally rectangular-shaped proximal face, a generally rectangular-shaped distal face, a longitudinal axis, and a centrally-and-longitudinally-disposed throughbore that extends along the longitudinal axis of the generally T-shaped body from the generally rectangular-shaped proximal face of the generally T-shaped body to the generally rectangular-shaped distal face of the generally T-shaped body and into which a respective one of the pair of mounting screws enters.

YET STILL ANOTHER OBJECT of the present invention is to provide a universal drawer handle wherein the generally T-shaped body has a generally rectangular-parallelepiped-shaped main portion with an end and a coaxially-disposed, laterally-outwardly-extending, and generally rectangular-parallelepiped-shaped head portion that is coaxial with, and extends laterally outwardly from, the end of the generally rectangular-parallelepiped-shaped main portion of the generally T-shaped body.

STILL YET ANOTHER OBJECT of the present invention is to provide a universal drawer handle wherein the coaxially-disposed, laterally-outwardly-extending, and generally rectangular-parallelepiped-shaped head portion of the generally T-shaped body is slidably mounted in the longitudinally-oriented and generally T-shaped track channel of the handle portion.

YET STILL ANOTHER OBJECT of the present invention is to provide a universal drawer handle wherein each of the pair of post portions has a generally T-shaped body with a generally circular-shaped proximal face, a generally rectangular-shaped distal face, a longitudinal axis, and a centrally-and-longitudinally-disposed throughbore that extends along the longitudinal axis of the generally T-shaped body from the generally circular-shaped proximal face of the generally T-shaped body to the generally rectangular-shaped distal face of the generally T-shaped body and into which a respective one of the pair of mounting screws enters.

STILL YET ANOTHER OBJECT of the present invention is to provide a universal drawer handle wherein the generally T-shaped body has a generally cylindrically-shaped main portion with an end and a coaxially-disposed, laterally-outwardly-extending, and generally rectangular-parallelepiped-shaped head portion that is coaxial with, and extends laterally outwardly, from the end of the generally cylindrically-shaped main portion of the generally T-shaped body.

YET STILL ANOTHER OBJECT of the present invention is to provide a universal drawer handle wherein the coaxially-disposed, laterally-outwardly-extending, and generally rectangular-parallelepiped-shaped head portion of the generally T-shaped body is slidably mounted in the longitudinally-oriented and generally T-shaped track channel of the handle portion.

STILL YET ANOTHER OBJECT of the present invention is to provide a universal drawer handle wherein each of the pair of post portions has a generally T-shaped body with a generally circular-shaped proximal face, a generally circular-shaped distal face, a longitudinal axis, and a centrally-and-longitudinally-disposed throughbore that extends along the longitudinal axis of the generally T-shaped body from the generally circular-shaped proximal face of the generally T-shaped body to the generally circular-shaped distal face of the generally T-shaped body and into which a respective one of the pair of mounting screws enters.

YET STILL ANOTHER OBJECT of the present invention is to provide a universal drawer handle wherein the generally T-shaped body has a generally cylindrically-shaped main portion with an end and a coaxially-disposed, laterally-outwardly-extending, and generally cylindrically-shaped head portion that is coaxial with, and extends laterally outwardly from, the end of the generally cylindrically-shaped main portion of the generally T-shaped body.

STILL YET ANOTHER OBJECT of the present invention is to provide a universal drawer handle wherein the coaxially-disposed, laterally-outwardly-extending, and generally cylindrically-shaped head portion of the generally T-shaped body is slidably mounted in the longitudinally-oriented and generally T-shaped track channel of the handle portion.

YET STILL ANOTHER OBJECT of the present invention is to provide a universal drawer handle wherein each of the pair of post portions has a generally T-shaped body with a generally rectangular-shaped proximal face, a generally circular-shaped distal face, a longitudinal axis, and a centrally-and-longitudinally-disposed throughbore that extends along the longitudinal axis of the generally T-shaped body from the generally rectangular-shaped proximal face of the generally T-shaped body to the generally circular-shaped distal face of the generally T-shaped body and into which a respective one of the pair of mounting screws enters.

STILL YET ANOTHER OBJECT of the present invention is to provide a universal drawer handle wherein the generally T-shaped body has a generally rectangular-parallelepiped-shaped main portion with an end and a coaxially-disposed, laterally-outwardly-extending, and generally cylindrically-shaped head portion that is coaxial with, and extends laterally outwardly from, the end of the generally rectangular-parallelepiped-shaped main portion of the generally T-shaped body.

YET STILL ANOTHER OBJECT of the present invention is to provide a universal drawer handle wherein the coaxially-disposed, laterally-outwardly-extending, and generally cylindrically-shaped head portion of the generally T-shaped body is slidably mounted in the longitudinally-oriented and generally T-shaped track channel of the handle portion.

STILL YET ANOTHER OBJECT of the present invention is to provide a universal drawer handle wherein each of the pair of post portions has a generally cylindrically-shaped body with a generally circular-shaped proximal face, a generally circular-shaped distal face, a longitudinal axis, and a centrally-and-longitudinally-disposed throughbore that extends along the longitudinal axis of the generally cylindrically-shaped body from the generally circular-shaped proximal face of the generally cylindrically-shaped body to the generally circular-shaped distal face of the generally cylindrically-shaped body and into which a respective one of the pair of mounting screws enters.

YET STILL ANOTHER OBJECT of the present invention is to provide a universal drawer handle wherein the generally cylindrically-shaped body is divided laterally into a generally cylindrically-shaped main portion and a coaxially-disposed and generally cylindrically-shaped head portion by a circumferentially-disposed annular groove.

STILL YET ANOTHER OBJECT Of the present invention is to provide a universal drawer handle wherein the coaxially-disposed and generally cylindrically-shaped head portion of the generally cylindrically-shaped body is coaxial with the generally cylindrically-shaped main portion of the generally cylindrically-shaped body.

YET STILL ANOTHER OBJECT of the present invention is to provide a universal drawer handle wherein the circumferencially-disposed annular groove of the generally cylindrically-shaped body extends circumferencially around the generally cylindrically-shaped body in proximity to the generally circular-shaped distal face of the generally cylindrically-parallelepiped-shaped body.

STILL YET ANOTHER OBJECT Of the present invention is to provide a universal drawer handle wherein the coaxially-disposed and generally cylindrically-shaped head portion of the generally cylindrically-shaped body is slidably mounted in the longitudinally-oriented and generally T-shaped track channel of the handle portion.

YET STILL ANOTHER OBJECT of the present invention is to provide a universal drawer handle wherein each of the pair of post portions has a body with a circular-shaped proximal face, a generally rectangular-shaped distal face, a longitudinal axis, and a centrally-and-longitudinally-disposed throughbore that extends along the longitudinal axis of the body from the generally circular-shaped proximal face of the body to the generally rectangular-shaped distal face of the body and into which a respective one of the pair of mounting screws enters.

STILL YET ANOTHER OBJECT of the present invention is to provide a universal drawer handle wherein the body is divided laterally into a generally cylindrically-shaped main portion and a coaxially-disposed and generally rectangular-parallelepiped-shaped head portion by a circumferencially-disposed annular groove.

YET STILL ANOTHER OBJECT of the present invention is to provide a universal drawer handle wherein the coaxially-disposed and generally rectangular-parallelepiped-shaped head portion of the body is coaxial with the generally cylindrically-shaped main portion of the body.

STILL YET ANOTHER OBJECT of the present invention is to provide a universal drawer handle wherein the circumferencially-disposed annular groove of the body extends circumferencially around the body in proximity to the generally rectangular-shaped distal face of the body.

YET STILL ANOTHER OBJECT of the present invention is to provide a universal drawer handle wherein the coaxially-disposed and generally rectangular-parallelepiped-shaped head portion of the body is slidably mounted in the longitudinally-oriented and generally T-shaped track channel of the handle portion.

STILL YET ANOTHER OBJECT of the present invention is to provide a universal drawer handle wherein each of the pair of post portions has a body with a generally rectangular-shaped proximal face, a generally circular-shaped distal face, a longitudinal axis, and a centrally-and-longitudinally-disposed throughbore that extends along the longitudinal axis of the body from the generally rectangular-shaped proximal face of the body to the generally circular-shaped distal face of the body and into which a respective one of the pair of mounting screws enters.

YET STILL ANOTHER OBJECT of the present invention is to provide a universal drawer handle wherein the body is divided laterally into a generally rectangular-parallelepiped-shaped main portion and a coaxially-disposed and generally cylindrically-shaped head portion by a circumferencially-disposed annular groove.

STILL YET ANOTHER OBJECT of the present invention is to provide a universal drawer handle wherein the coaxially-disposed and generally cylindrically-shaped head portion of the body is coaxial with the generally rectangular-parallelepiped-shaped main portion of the body.

YET STILL ANOTHER OBJECT of the present invention is to provide a universal drawer handle wherein the circumferencially-disposed annular groove of the body extends circumferencially around the body in proximity to the generally circular-shaped distal face of the body.

STILL YET ANOTHER OBJECT of the present invention is to provide a universal drawer handle wherein the coaxially-disposed and generally cylindrically-shaped head portion of the body is slidably mounted in the longitudinally-oriented and generally T-shaped track channel of the handle portion.

YET STILL ANOTHER OBJECT of the present invention is to provide a universal drawer handle that further includes a length adjustable filler element that is insertable in the longitudinally-oriented and generally T-shaped track channel of the handle portion.

STILL YET ANOTHER OBJECT of the present invention is to provide a universal drawer handle wherein the length adjustable filler element has an elongated and generally T-shaped body that is length adjustable by a plurality of laterally-oriented and spaced-apart break slots, so that the longitudinally-oriented and generally T-shaped track channel of the elongated, generally rectangular-parallelepiped-shaped, and open-ended body of the handle portion can be filled between the pair of post portions.

YET STILL ANOTHER OBJECT of the present invention is to provide a universal drawer handle that further includes a pair of generally cylindrically-shaped filler plugs that are insertable in the pair of post portions and cooperate with the free ends of the pair of mounting screws, so that the universal drawer handle can be used with conventional drawer fronts of varying thicknesses.

STILL YET ANOTHER OBJECT of the present invention is to provide a universal drawer handle wherein the pair of generally cylindrically-shaped filler plugs are selected from the group consisting of rubber, plastic, and metal.

YET STILL ANOTHER OBJECT of the present invention is to provide a method of using a universal drawer handle to replace a handle of any size on a drawer front of any thickness that includes the steps of passing a pair of mounting screws of the universal drawer handle through a pair of conventional handle mounting holes in a conventional drawer front of a conventional drawer from inside the conventional drawer, threading a pair of post portions of the universal drawer handle onto the pair of mounting screws with each of the pair of mounting screws threadably engaging a centrally-and-longitudinally-disposed throughbore of a respective one of the pair of post portions, sliding a handle portion of the universal drawer handle onto the pair of post portions with a head portion of each of the pair of post portions sliding in a longitudinally-oriented and generally T-shaped track channel of the handle portion, positioning the handle portion relative to the pair of post portions, and tightening the pair of mounting screws until a pair of free ends of the pair of mounting screws exert a force on a wall of the longitudinally-oriented and generally T-shaped track channel of the handle portion, so that the handle portion is secured to the pair of post portions and prevented from lateral movement relative thereto while the pair of post portions are secured between the conventional drawer front of the conventional drawer and the handle portion.

STILL YET ANOTHER OBJECT of the present invention is to provide a method of using a universal drawer handle to replace a handle of any size on a drawer front of any thickness that further includes the steps of adjusting the length of a resilient, length adjustable, and generally T-shaped track filler of the universal drawer handle to the distance between the pair of post portions by removing an appropriated portion of the resilient, length adjustable, track filler via the use of an appropriate one of a plurality of laterally-oriented and spaced-apart break slots that are disposed laterally on the resilient, length adjustable, and generally T-shaped track filler, and sliding the properly lengthed resilient, length adjustable, and generally T-shaped track filler into the longitudinally-oriented and generally T-shaped track channel of the handle portion after the handle portion has been slid onto one post portion of the pair of post portions, but before the handle portion is slid onto another post portion of the pair of post portions to a position where the pair of post portions straddle the properly lengthed resilient, length adjustable, and generally T-shaped track filler, so that the space between the pair of post portions is filled.

FINALLY, YET STILL ANOTHER OBJECT of the present invention is to provide a method of using a universal drawer handle to replace a handle of any size on a drawer front of any thickness that further includes the step inserting a filler plug into the centrally-and-longitudinally-disposed throughbore of each of the pair of post portions prior to the threading step, so that varying thicknesses of the conventional drawer front of the conventional drawer can be compensated for.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
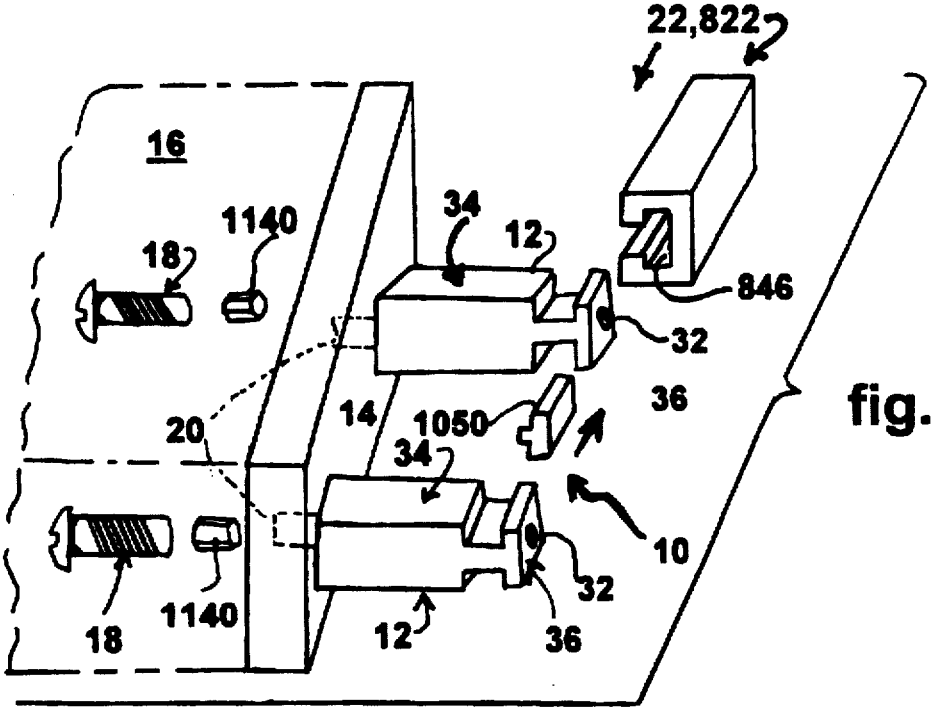
FIG. 1 is an exploded perspective view of the preferred embodiment of the universal drawer handle of the present invention being mounted to a conventional drawer front of a conventional drawer by a pair of mounting screws that pass through the conventional handle mounting holes in the conventional drawer front of the conventional drawer and illustrating the use of the optional thickness compensating generally cylindrically-shaped filler plugs of the pair of post portions and the resilient and length adjustable track filler of the handle portion.

10 universal drawer handle of the present invention
12 pair of post portions
14 conventional drawer front
16 conventional drawer
18 pair of mounting screws
20 pair of conventional handle mounting holes
22 handle portion
24 post portion generally rectangular-parallelepiped-shaped body
26 post portion body generally rectangular-shaped proximal face
28 post portion body generally rectangular-shaped distal face
30 post portion body longitudinal axis
32 post portion body centrally-and-longitudinally-disposed throughbore
34 post portion body generally rectangular-parallelepiped-shaped main portion
36 post portion body generally rectangular-parallelepiped-shaped head portion
38 pair of post portion body laterally-oriented, opposingly aligned, and generally rectangular-parallelepiped-shaped grooves

First Alternate Embodiment of the Pair of Post Portions

112 pair of post portions
124 post portion generally T-shaped body
126 post portion body generally rectangular-shaped proximal face
128 post portion body generally rectangular-shaped distal face
130 post portion body longitudinal axis
132 post portion body centrally-and-longitudinally-disposed throughbore
134 post portion body generally rectangular-parallelepiped-shaped main portion
136 post portion body coaxially-disposed, laterally-outwardly-extending, and generally rectangular-parallelepiped-shaped head portion

Second Alternate Embodiment of the Pair of Post Portions

212 pair of post portions
224 post portion generally T-shaped body
226 post portion body generally circular-shaped proximal face
228 post portion body generally rectangular-shaped distal face
230 post portion body longitudinal axis
232 post portion body centrally-and-longitudinally-disposed throughbore
234 post portion body generally cylindrically-shaped main portion
236 post portion body coaxially-disposed, laterally-outwardly-extending, and generally rectangular-parallelepiped-shaped head portion

Third Alternate Embodiment of the Pair of Post Portions

312 pair of post portions
324 post portion generally T-shaped body
326 post portion body generally circular-shaped proximal face
328 post portion body generally circular-shaped distal face
330 post portion body longitudinal axis
332 post portion body centrally-and-longitudinally-disposed throughbore
334 post portion body generally cylindrically-shaped main portion
336 post portion body coaxially-disposed, laterally-outwardly-extending, and generally cylindrically-shaped head portion

Fourth Alternate Embodiment of the Pair of Post Portions

412 pair of post portions
424 post portion generally T-shaped body
426 post portion body generally rectangular-shaped proximal face
428 post portion body generally circular-shaped distal face
430 post portion body longitudinal axis
432 post portion body centrally-and-longitudinally-disposed throughbore 434 post portion body generally rectangular-parallelepiped-shaped main portion
436 post portion body coaxially-disposed, laterally-outwardly-extending, and generally cylindrically-shaped head portion Fifth Alternate Embodiment of the Pair of Post Portions 512 pair of post portions
524 post portion generally cylindrically-shaped body
526 post portion body generally circular-shaped proximal face
528 post portion body generally circular-shaped distal face
530 post portion body longitudinal axis
532 post portion body centrally-and-longitudinally-disposed throughbore
534 post portion body generally cylindrically-shaped main portion
536 post portion body coaxially-disposed and generally cylindrically-shaped head portion
538 post portion body circumferentially-disposed annular groove Sixth Alternate Embodiment of the Pair of Post Portions 612 pair of post portions
624 post portion body
626 post portion body generally circular-shaped proximal face
628 post portion body generally rectangular-shaped distal face
630 post portion body longitudinal axis
632 post portion body centrally-and-longitudinally-disposed and throughbore
634 post portion body generally cylindrically-shaped main portion
636 post portion body coaxially-disposed and generally rectangular-parallelepiped-shaped head portion
638 post portion body circumferentially-disposed annular groove Seventh Alternate Embodiment of the Pair of Post Portions 712 pair of post portions
724 post portion body
726 post portion body generally rectangular-shaped proximal face
728 post portion body generally circular-shaped distal face
730 post portion body longitudinal axis
732 post portion body centrally-and-longitudinally-disposed throughbore
734 post portion body generally rectangular-parallelepiped-shaped main portion
736 post portion body coaxially-disposed and generally cylindrically-shaped head portion
738 post portion body circumferentially-disposed annular groove Preferred Embodiment of the Handle Portion 822 handle portion
840 handle portion elongated, generally rectangular-parallelepiped-shaped, and open-ended body
842 handle portion generally rectangular-shaped rear face
844 handle portion longitudinal axis
846 handle portion longitudinally-oriented and generally T-shaped track channel
848 handle portion channel portion Alternate Embodiment of the Handle Portion 922 handle portion
940 handle portion elongated, generally cylindrically-shaped, and open-ended body
942 handle portion generally arcuate-shaped rear face
944 handle portion longitudinal axis
946 handle portion longitudinally-oriented and T-shaped track channel
948 handle portion channel portion Preferred Embodiment of the Resilient, Length Adjustable, And Generally T-Shaped Track Filler 1050 resilient, length adjustable, and generally T-shaped track filler
1052 track filler elongated and generally T-shaped body
1054 plurality of track filler body laterally-oriented and spaced-apart break slots Preferred Embodiment of the Thickness Compensating Generally Cylindrically-Shaped Filler Plug 1140 thickness compensating generally cylindrically-shaped filler plug

DETAILED DESCRIPTION OF THE PREFERRED EMBODIMENT

Referring now to the figures in which like numerals indicate like parts, and particularly to FIG. 1, the universal drawer handle of the present invention is shown generally at 10 and has a pair of post portions 12 that are removably mounted to a conventional drawer front 14 of a conventional drawer 16 by a pair of mounting screws 18 that pass through a pair of conventional handle mounting holes 20 in the conventional drawer front 14 of the conventional drawer 16.

The pair of post portions 12 is preferably made from wood, plastic or metal, depending on user preference.

The universal drawer handle 10 further has a handle portion 22 that is slidably mounted to any position on the pair of post portions 12, so that the handle portion 22 is free to slide relative to the pair of post portions 12 and adjust for different spacings between the conventional handle mounting holes 20 of different conventional drawer fronts 14 of different conventional drawers 16.

The handle portion 22 is preferably made from wood, plastic, or metal, and is preferably smooth or rippled depending on user preference.

The ability of the handle portion 22 to slide relative to the pair of post portions 12 allows the universal drawer handle 10 to be used to replace a wide variety of different sized drawer handles.

It is to be understood, however, that the use of the universal drawer handle 10 on the conventional drawer 16 is a preferable mode and that the universal drawer handle 10 can be used on other objects that utilize handles.

Figure 2:
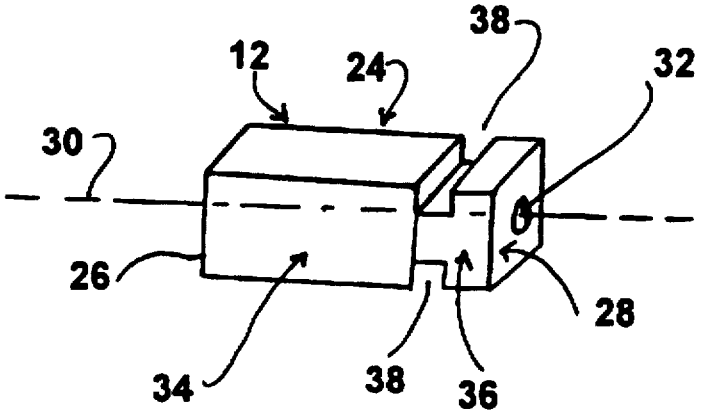
FIG. 2 is a perspective view of a preferred embodiment of a post portion of the pair of post portions of the universal drawer handle of the present invention.

The configuration of a preferred embodiment of each of the pair of post portions 12 can best be seen in FIG. 2, and as such, will be discussed with reference thereto.

Each of the pair of post portions 12 has a post portion generally rectangular-parallelepiped-shaped body 24 with a post portion body generally rectangular-shaped proximal face 26, a post portion body generally rectangular-shaped distal face 28, a post portion body longitudinal axis 30, and a post portion body centrally-and-longitudinally-disposed throughbore 32 that extends along the post portion body longitudinal axis 30 of the post portion generally rectangular-parallelepiped-shaped body 24 from the post portion body generally rectangular-shaped proximal face 26 of the post portion generally rectangular-parallelepiped-shaped body 24 to the post portion generally rectangular-shaped distal face 28 of the post portion generally rectangular-parallelepiped-shaped body 24.

The post portion generally rectangular-parallelepiped-shaped body 24 is divided laterally into a post portion body generally rectangular-parallelepiped-shaped main portion 34 and a post portion body generally rectangular-parallelepiped-shaped head portion 36 by a pair of post portion body laterally-oriented, opposingly aligned, and generally rectangular-parallelepiped-shaped grooves 38.

The pair of post portion body laterally-oriented, opposingly aligned, and generally rectangular-parallelepiped-shaped grooves 38 of the post portion generally rectangular-parallelepiped-shaped body 24 extends in a lateral direction, and in opposing alignment to each other, across the post portion generally rectangular-parallelepiped-shaped body 24 in proximity to the post portion generally rectangular-shaped distal face 28 of the post portion generally rectangular-parallelepiped-shaped body 24, so that the post portion body generally rectangular-parallelepiped-shaped main portion 34 of the post portion generally rectangular-parallelepiped-shaped body 24 is preferably longitudinally longer than the post portion body generally rectangular-parallelepiped-shaped head portion 36 of the post portion generally rectangular-parallelepiped-shaped body 24, but as discussed, infra, can be eliminated completely.

The cross section of the post portion body generally rectangular-parallelepiped-shaped main portion 34 of the post portion generally rectangular-parallelepiped-shaped body 24 is substantially similar to the cross section of the post portion body generally rectangular-parallelepiped-shaped head portion 36 of the post portion generally rectangular-parallelepiped-shaped body 24.

Figure 3:
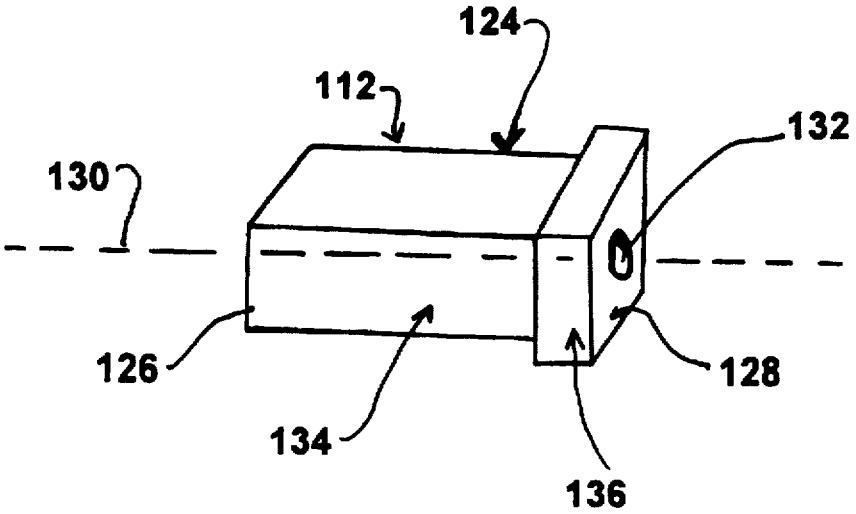
FIG. 3 is a perspective view of a first alternate embodiment of the post portion of the pair of post portions of the universal drawer handle of the present invention.

The configuration of a first alternate embodiment of each of a pair of post portions 112 can best be seen in FIG. 3, and as such, will be discussed with reference thereto.

Each of the pair of post portions 112 has a post portion generally T-shaped body 124 with a post portion body generally rectangular-shaped proximal face 126, a post portion body generally rectangular-shaped distal face 128, a post portion body longitudinal axis 130, and a post portion body centrally-and-longitudinally-disposed throughbore 132 that extends along the post portion body longitudinal axis 130 of the post portion generally T-shaped body 124 from the post portion body generally rectangular-shaped proximal face 126 of the post portion generally T-shaped body 124 to the post portion generally rectangular-shaped distal face 128 of the post portion generally T-shaped body 124.

The post portion generally T-shaped body 124 has a post portion body generally rectangular-parallelepiped-shaped main portion 134 and a post portion body coaxially-disposed, laterally-outwardly-extending, and generally rectangular-parallelepiped-shaped head portion 136 that is coaxial with, and extends laterally outwardly from, an end of the post portion body generally rectangular-parallelepiped-shaped main portion 134 of the post portion generally T-shaped body 124.

The post portion body generally rectangular-parallelepiped-shaped main portion 134 of the post portion generally T-shaped body 124 is preferably longitudinally longer than the post portion body coaxially-disposed, laterally-outwardly-extending, and generally rectangular-parallelepiped-shaped head portion 136 of the post portion generally T-shaped body 124.

Figure 4:
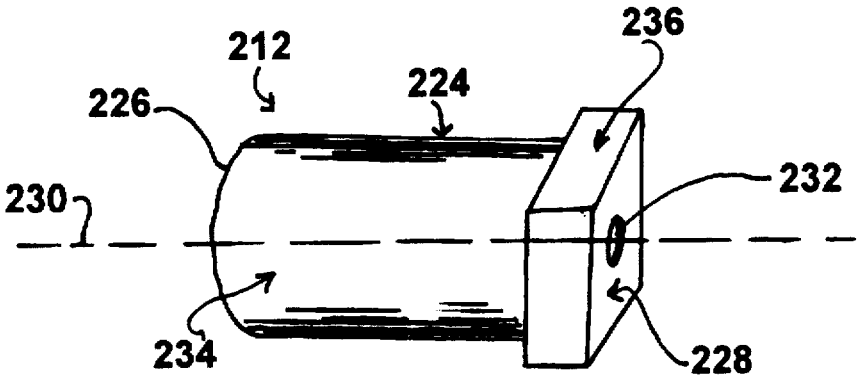
FIG. 4 is a perspective view of a second alternate embodiment of the post portion of the pair of post portions of the universal drawer handle of the present invention.

The configuration of a second alternate embodiment of each of a pair of post portions 212 can best be seen in FIG. 4, and as such, will be discussed with reference thereto.

Each of the pair of post portions 212 has a post portion generally T-shaped body 224 with a post portion body generally circular-shaped proximal face 226, a post portion body generally rectangular-shaped distal face 228, a post portion body longitudinal axis 230, and a post portion body centrally-and-longitudinally-disposed throughbore 232 that extends along the post portion body longitudinal axis 230 of the post portion generally T-shaped body 224 from the post portion body generally circular-shaped proximal face 226 of the post portion generally T-shaped body 224 to the post portion generally rectangular-shaped distal face 228 of the post portion generally T-shaped body 224.

The post portion generally T-shaped body 224 has a post portion body generally cylindrically-shaped main portion 234 and a post portion body coaxially-disposed, laterally-outwardly-extending, and generally rectangular-parallelepiped-shaped head portion 236 that is coaxial with, and extends laterally outwardly from, an end of the post portion body generally cylindrically-shaped main portion 234 of the post portion generally T-shaped body 224.

The post portion body generally cylindrically-shaped main portion 234 of the post portion generally T-shaped body 224 is preferably longitudinally longer than the post portion body coaxially-disposed, laterally-outwardly-extending, and generally rectangular-parallelepiped-shaped head portion 236 of the post portion generally T-shaped body 224.

Figure 5:
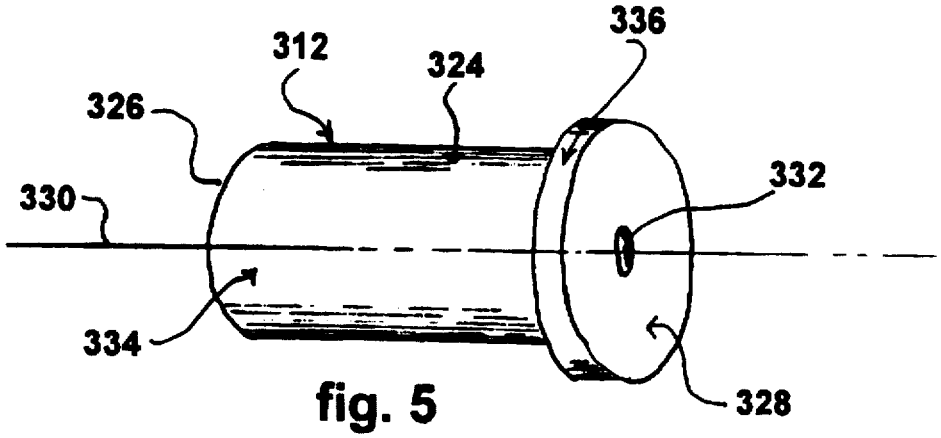
FIG. 5 is a perspective view of a third alternate embodiment of the post portion of the pair of post portions of the universal drawer handle of the present invention.

The configuration of a third alternate embodiment of each of a pair of post portions 312 can best be seen in FIG. 5, and as such, will be discussed with reference thereto.

Each of the pair of post portions 312 has a post portion generally T-shaped body 324 with a post portion body generally circular-shaped proximal face 326, a post portion body generally circular-shaped distal face 328, a post portion body longitudinal axis 330, and a post portion body centrally-and-longitudinally-disposed throughbore 332 that extends along the post portion body longitudinal axis 330 of the post portion generally T-shaped body 324 from the post portion body generally circular-shaped proximal face 326 of the post portion generally T-shaped body 324 to the post portion generally circular-shaped distal face 328 of the post portion generally T-shaped body 324.

The post portion generally T-shaped body 324 has a post portion body generally cylindrically-shaped main portion 334 and a post portion body coaxially-disposed, laterally-outwardly-extending, and generally cylindrically-shaped head portion 336 that is coaxial with, and extends laterally outwardly from, an end of the post portion body generally cylindrically-shaped main portion 334 of the post portion generally T-shaped body 324.

The post portion body generally cylindrically-shaped main portion 334 of the post portion generally T-shaped body 324 is preferably longitudinally longer than the post portion body generally cylindrically-shaped head portion 336 of the post portion generally T-shaped body 324.

Figure 6:
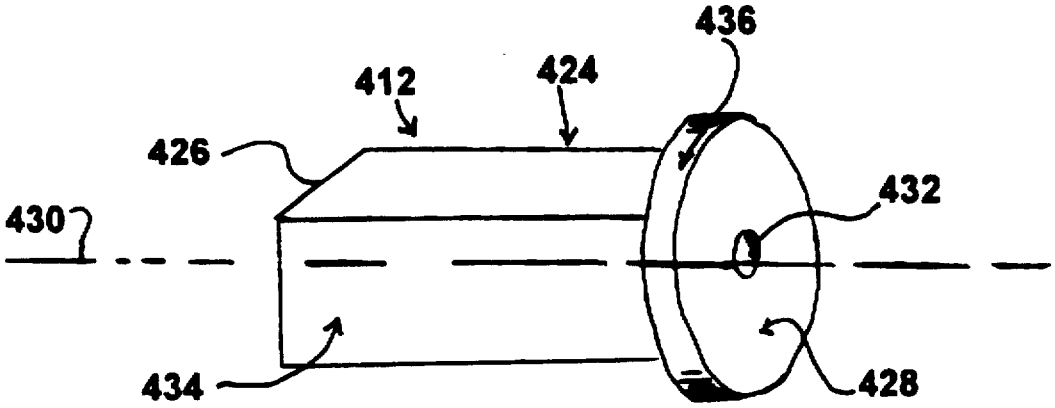
FIG. 6 is a perspective view of a fourth alternate embodiment of the post portion of the pair of post portions of the universal drawer handle of the present invention.

The configuration of a fourth alternate embodiment of each of a pair of post portions 412 can best be seen in FIG. 6, and as such, will be discussed with reference thereto.

Each of the pair of post portions 412 has a post portion generally T-shaped body 424 with a post portion body generally rectangular-shaped proximal face 426, a post portion body generally circular-shaped distal face 428, a post portion body longitudinal axis 430, and a post portion body centrally-and-longitudinally-disposed throughbore 432 that extends along the post portion body longitudinal axis 430 of the post portion generally T-shaped body 424 from the post portion body generally rectangular-shaped proximal face 426 of the post portion generally T-shaped body 424 to the post portion generally circular-shaped distal face 428 of the post portion generally T-shaped body 424.

The post portion generally T-shaped body 424 has a post portion body generally rectangular-parallelepiped-shaped main portion 434 and a post portion body coaxially-disposed, laterally-outwardly-extending, and generally cylindrically-shaped head portion 436 that is coaxial with, and extends laterally outwardly from, an end of the post portion body generally rectangular-parallelepiped-shaped main portion 434 of the post portion generally T-shaped body 424.

The post portion body generally rectangular-parallelepiped-shaped main portion 434 of the post portion generally T-shaped body 424 is preferably longitudinally longer than the post portion body coaxially-disposed, laterally-outwardly-extending, and generally cylindrically-shaped head portion 436 of the post portion generally T-shaped body 424.

Figure 7:
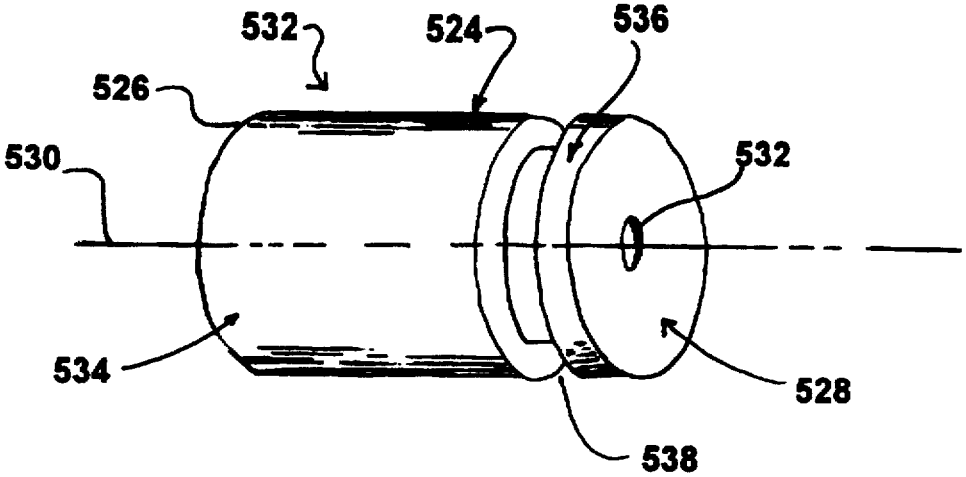
FIG. 7 is a perspective view of a fifth alternate embodiment of the post portion of the pair of post portions of the universal drawer handle of the present invention.

The configuration of a fifth embodiment of each of the pair of post portions 512 can best be seen in FIG. 7, and as such, will be discussed with reference thereto.

Each of the pair of post portions 512 has a post portion generally cylindrically-shaped body 524 with a post portion body generally circular-shaped proximal face 526, a post portion body generally circular-shaped distal face 528, a post portion body longitudinal axis 530, and a post portion body centrally-and-longitudinally-disposed throughbore 532 that extends along the post portion body longitudinal axis 530 of the post portion generally cylindrically-shaped body 524 from the post portion body generally circular-shaped proximal face 526 of the post portion generally cylindrically-shaped body 524 to the post portion generally circular-shaped distal face 528 of the post portion generally cylindrically-shaped body 524.

The post portion generally cylindrically-shaped body 524 is divided laterally into a post portion body generally cylindrically-shaped main portion 534 and a post portion body coaxially-disposed and generally cylindrically-shaped head portion 536 by a post portion body circumferentially-disposed annular groove 538. The post portion body coaxially-disposed and generally cylindrically-shaped head portion 536 of the post portion generally cylindrically-shaped body 524 is coaxial with the post portion body generally cylindrically-shaped main portion 534 of the post portion generally cylindrically-shaped body 524.

The post portion body circumferentially-disposed annular groove 538 of the post portion generally cylindrically-shaped body 524 extends circumferentially around the post portion generally cylindrically-shaped body 524 in proximity to the post portion generally circular-shaped distal face 528 of the post portion generally cylindrically-shaped body 524, so that the post portion body generally cylindrically-shaped main portion 534 of the post portion generally cylindrically-shaped body 524 is preferably longitudinally longer than the post portion body coaxially-disposed and generally cylindrically-shaped head portion 536 of the post portion generally cylindrically-shaped body 524.

The cross section of the post portion body generally cylindrically-shaped main portion 534 of the post portion generally cylindrically-shaped body 524 is preferably substantially similar to the cross section of the post portion body coaxially-disposed and generally cylindrically-shaped head portion 536 of the post portion generally cylindrically-shaped body 524.

Figure 8:
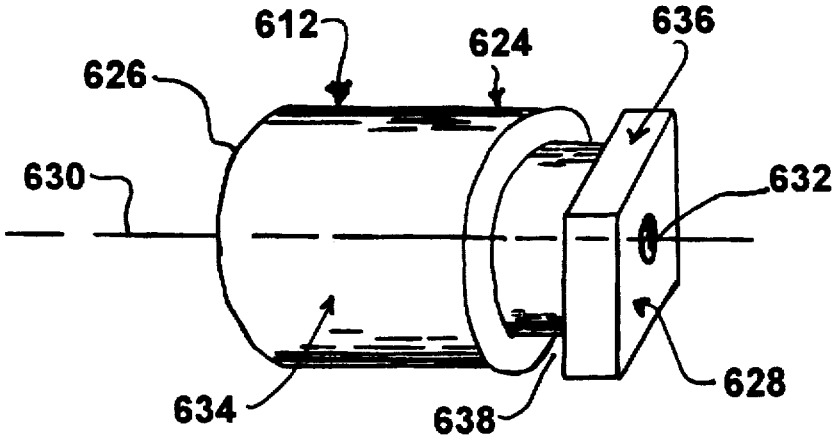
FIG. 8 is a perspective view of a sixth alternate embodiment of the post portion of the pair of post portions of the universal drawer handle of the present invention.

The configuration of a sixth embodiment of each of the pair of post portions 612 can best be seen in FIG. 8, and as such, will be discussed with reference thereto.

Each of the pair of post portions 612 has a post portion body 624 with a post portion body generally circular-shaped proximal face 626, a post portion body generally rectangular-shaped distal face 628, a post portion body longitudinal axis 630, and a post portion body centrally-and-longitudinally-disposed throughbore 632 that extends along the post portion body longitudinal axis 630 of the post portion body 624 from the post portion body generally circular-shaped proximal face 626 of the post portion body 624 to the post portion generally rectangular-shaped distal face 628 of the post portion body 624.

The post portion body 624 is divided laterally into a post portion body generally cylindrically-shaped main portion 634 and a post portion body coaxially-disposed and generally rectangular-parallelepiped-shaped head portion 636 by a post portion body circumferentially-disposed annular groove 638. The post portion body coaxially-disposed and generally rectangular-parallelepiped-shaped head portion 636 of the post portion body 624 is coaxial with the post portion body generally cylindrically-shaped main portion 634 of the post portion body 624.

The post portion body circumferentially-disposed annular groove 638 of the post portion body 624 extends circumferentially around the post portion body 624 in proximity to the post portion generally rectangular-shaped distal face 628 of the post portion body 624, so that the post portion body generally cylindrically-shaped main portion 634 of the post portion body 624 is preferably longitudinally longer than the post portion body coaxially-disposed and generally rectangular-parallelepiped-shaped head portion 636 of the post portion body 624.

Figure 9:
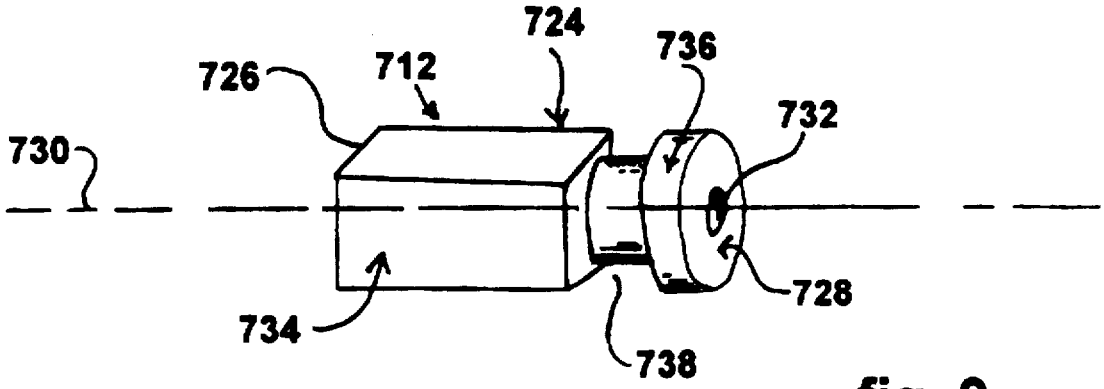
FIG. 9 is a perspective view of a seventh alternate embodiment of the post portion of the pair of post portions of the universal drawer handle of the present invention.

The configuration of a seventh embodiment of each of the pair of post portions 712 can best be seen in FIG. 9, and as such, will be discussed with reference thereto.

Each of the pair of post portions 712 has a post portion body 724 with a post portion body generally rectangular-shaped proximal face 726, a post portion body generally circular-shaped distal face 728, a post portion body longitudinal axis 730, and a post portion body centrally-and-longitudinally disposed throughbore 732 that extends along the post portion body longitudinal axis 730 of the post portion body 724 from the post portion body generally rectangular-shaped proximal face 726 of the post portion body 724 to the post portion generally circular-shaped distal face 728 of the post portion shaped body 724.

The post portion body 724 is divided laterally into a post portion body generally rectangular-parallelepiped-shaped main portion 734 and a post portion body coaxially-disposed and generally cylindrically-shaped head portion 736 by a post portion body circumferentially-disposed annular groove 738. The post portion body coaxially-disposed and generally cylindrically-shaped head portion 736 of the post portion body 724 is coaxial with the post portion body generally rectangular-parallelepiped-shaped main portion 734 of the post portion body 724.

The post portion body circumferentially-disposed annular groove 738 of the post portion body 724 extends circumferentially around the post portion body 724 in proximity to the post portion generally circular-shaped distal face 728 of the post portion body 724, so that the post portion body generally rectangular-parallelepiped-shaped main portion 734 of the post portion body 724 is preferably longitudinally longer than the post portion body coaxially-disposed and generally cylindrically-shaped head portion 736 of the post portion body 724.

Figure 10:
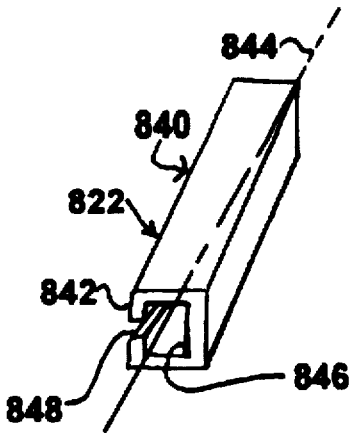
FIG. 10 is a perspective view of a preferred embodiment of a handle portion of the universal drawer handle of the present invention.

The configuration of a preferred embodiment of the handle portion 822 can best be seen in FIG. 10, and as such, will be discussed with reference thereto.

The handle portion 822 has a handle portion elongated, generally rectangular-parallelepiped-shaped, and open-ended body 840 with a handle portion generally rectangular-shaped rear face 842 and a handle portion longitudinal axis 844.

The handle portion elongated, generally rectangular-parallelepiped-shaped, and open-ended body 840 further has a handle portion longitudinally-oriented and generally T-shaped track channel 846 that extends along the handle portion longitudinal axis 844 of the handle portion elongated, generally rectangular-parallelepiped-shaped, and open-ended body 840 and opens into the open-ends of the handle portion elongated, generally rectangular-parallelepiped-shaped, and open-ended body 840.

The handle portion longitudinally-oriented and generally T-shaped track channel 846 of the handle portion elongated, generally rectangular-parallelepiped-shaped, and open-ended body 840 has a handle portion channel portion 848 that opens into the handle portion generally rectangular-shaped rear face 842 of the handle portion elongated and generally rectangular-parallelepiped-shaped body 840.

Figure 11:
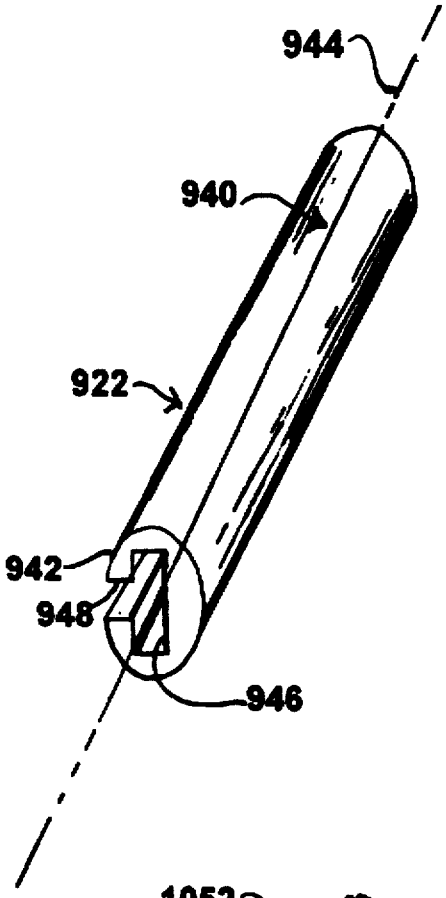
FIG. 11 is a perspective view of an alternate embodiment of the handle portion of the universal drawer handle of the present invention.

The configuration of an alternate embodiment of a handle portion 922 can best be seen in FIG. 11, and as such, will be discussed with reference thereto.

The handle portion 922 has a handle portion elongated, generally cylindrically-shaped, and open-ended body 940 with a handle portion generally arcuate-shaped rear face 942 and a handle portion longitudinal axis 944.

The handle portion elongated, generally cylindrically-shaped, and open-ended body 940 further has a handle portion longitudinally-oriented and generally T-shaped track channel 946 that extends along the handle portion longitudinal axis 944 of the handle portion elongated, generally cylindrically-shaped, and open-ended body 940 and opens into the open-ends of the handle portion elongated, generally cylindrically-shaped, and open-ended body 940.

The handle portion longitudinally-oriented and generally T-shaped track channel 946 of the handle portion elongated, generally cylindrically-shaped, and open-ended body 940 has a handle portion channel portion 948 that opens into the handle portion generally arcuate-shaped rear face 942 of the handle portion elongated and generally cylindrically-shaped body 940.

Figure 12:
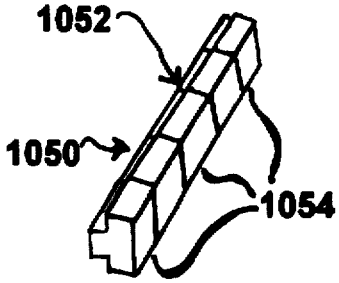
FIG. 12 is a perspective view of a length adjustable track filler of the universal drawer handle of the present invention to fill the space between the pair of post portions of the universal drawer handle of the present invention.

The configuration of a resilient, length adjustable, and generally T-shaped track filler 1050 can best be seen in FIG. 12, and as such, will be discussed with reference thereto.

The resilient, length adjustable, and generally T-shaped track filler 1050 is preferably rubber, plastic or metal.

The resilient, length adjustable, and generally T-shaped track filler 1050 is insertable into the handle portion longitudinally-oriented and generally T-shaped track channel 846 of the handle portion elongated, generally rectangular-parallelepiped-shaped, and open-ended body 840 of the handle portion 822 or the handle portion longitudinally-oriented and generally T-shaped track channel 946 of the handle portion elongated, generally cylindrically-shaped, and open-ended body 940 of the handle portion 922 and fills the space between the pair of post portions 112, 212, 312, 412, 512, 612, 712 that the user desires to use.

Additionally, the resilient, length adjustable, and generally T-shaped track filler 1050 provides a cushion when a user hand of the user grabs the handle portion elongated, generally rectangular-parallelepiped-shaped, and open-ended body 840 of the handle portion 822 or the handle portion elongated, generally cylindrically-shaped, and open-ended body 940 of the handle portion 922.

The resilient, length adjustable, and generally T-shaped track filler 1050 has a track filler elongated and generally T-shaped body 1052 that is made from a resilient material and is length adjustable by the incorporation of a plurality of track filler body laterally-oriented and spaced-apart break slots 1054.

The cross section of the track filler elongated and generally T-shaped body 1052 of the resilient, length adjustable, and generally T-shaped track filler 1050 is substantially similar to the cross section of the handle portion longitudinally-oriented and generally T-shaped track channel 846 of the handle portion elongated, generally rectangular-parallelepiped-shaped, and open-ended body 840 of the handle portion 822 and the handle portion longitudinally-oriented and generally T-shaped track channel 946 of the handle portion elongated, generally cylindrically-shaped, and open-ended body 940 of the handle portion 922, so as to be inserted therein.

The operation of the universal drawer handle 10 can best be seen in FIG. 1, and as such, will be discussed with reference thereto.

The operation of the universal drawer handle 10 will be discussed with reference to the preferred embodiments of the pair of post portions 12 and the handle portion 822 for purposes of illustration, however, it is to be understood that the alternate embodiments of the pair of post portions 112, 212, 312, 412, 512, 612, 712 and the alternate embodiment of the handle portion 922 operate in the same general way and are therefore interchangeable, so that any of the embodiments of the pair of post portions 12 can be used with any of the embodiments of the handle portion 22, depending on user preference.

Further, it is to be understood that one post portion of any of the pair of post portions 12, 112, 212, 312, 412, 512, 612, 712 can be paired with any other post portion of the pair of post portions 12, 112, 212, 312, 412, 512, 612, 712 adding further to the ability of the user to customize the universal drawer handle 10.

Each of the pair of mounting screws 18 is passed through a respective one of the pair of conventional handle mounting holes 20 in the conventional drawer front 14 of the conventional drawer 16 from inside the conventional drawer 16.

Each of the pair of post portions 12 is placed onto a respective one of the pair of mounting screws 18 with each of the pair of mounting screws 18 threadably engaging the post portion body centrally-and-longitudinally disposed throughbore 32 of a respective one of the pair of post portions 12.

The length of the resilient, length adjustable, and generally T-shaped track filler 1050 is adjusted to the distance between the pair of post portions 12 by removing an appropriated portion of the resilient, length adjustable, and generally T-shaped track filler 1050 via the use of the appropriate one of the plurality of track filler body laterally-oriented and spaced-apart break slots 1054 of the resilient, length adjustable, and generally T-shaped track filler 1050.

The properly lengthed resilient, length adjustable, and generally T-shaped track filler 1050 is slid into the handle portion longitudinally-oriented and generally T-shaped track channel 846 of the handle portion elongated, generally rectangular-parallelepiped-shaped, and open-ended body 840 of the handle portion 822 after the handle portion 822 has been skid onto one post portion of the pair of post portions 12, but before the handle portion 822 is slid onto another post portion of the pair of post portions 12.

The handle portion 822 is slid onto the pair of post portions 12 with the post portion body generally rectangular-parallelepiped-shaped head portion 36 of each of the pair of post portions 12 sliding in the handle portion longitudinally-oriented and generally T-shaped track channel 846 of the handle portion elongated, generally rectangular-parallelepiped-shaped, and open-ended body 840 of the handle portion 822 and straddling the properly lengthed resilient, length adjustable, and generally T-shaped track filler 1050, so that the properly lengthed resilient, length adjustable, and generally T-shaped track filler 1050 fills the space between the pair of post portions 12.

The handle portion 822 is positioned relative to the pair of post portions 12, preferably centrally, but may vary depending on user preference.

The pair of mounting screws 18 are tightened until the ends of the pair of mounting screws 18 exert a force on the inside of the handle portion longitudinally-oriented and generally T-shaped track channel 846 of the handle portion elongated, generally rectangular-parallelepiped-shaped, and open-ended body 840 of the handle portion 822, so that the handle portion 822 is secured to the pair of post portions 12 and prevented from lateral movement relative thereto while the pair of post portions 12 are secured between the conventional drawer front 14 of the conventional drawer 16 and the handle portion 822.

As shown in FIG. 1, to compensate for varying thicknesses of different conventional drawer fronts 14 of different conventional drawers 16, a thickness compensating generally cylindrically-shaped filler plug 1140 can be inserted into the post portion body centrally-and-longitudinally-disposed throughbore 32 of each of the pair of post portions 12 prior to threading the pair of post portions 12 onto the pair of mounting screws 18.

The thickness compensating generally cylindrically-shaped filler plug 1140 is preferably rubber, plastic, or metal.

As stated, supra, if so desired by the user, the post portion body generally rectangular-parallelepiped-shaped main portion 34 of each of the pair of post portions 12 can be eliminated completely, so that the handle portion 822 will abut the outer surface of the conventional drawer front 14 of the conventional drawer 16 and slide relative thereto.

It will be understood that each of the elements described above, or two or more together, may also find a useful application in other types of constructions differing from the types described above.

While the invention has been illustrated and described as embodied in a universal drawer handle, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A universal drawer handle, comprising:

a) a pair of mounting screws;

b) a pair of post portions removably mounted to a conventional drawer front of a conventional drawer by said pair of mounting screws having free ends passing through a pair of conventional handle mounting holes in the conventional drawer front of the conventional drawer; and c) a handle portion slidably mounted to any desired position on said pair of post portions, so that said handle portion is free to slide relative to said pair of post portions and adjust for different spacings between different pairs of conventional handle mounting holes of different conventional drawer fronts of different conventional drawers so as to allow said universal drawer handle to be used to replace different sized drawer handles; said pair of mounting screws being tightened until said free ends of said pair of mounting screws exert a force on said handle portion when said desired position of said handle portion has been achieved, so that the handle portion is secured to the pair of post portions and prevented from lateral movement relative thereto while the pair of post portions are secured between the conventional drawer front of the conventional drawer and the handle portion.

2. The handle as defined in claim 1, wherein said pair of post portions and said handle portion are selected from the group consisting of wood, plastic, and metal.

3. The handle as defined in claim 1, wherein said handle portion has an elongated, generally rectangular-parallelepiped-shaped, and open-ended body with open ends, a generally rectangular-shaped rear face, and a longitudinal axis; said elongated, generally rectangular-parallelepiped-shaped, and open-ended body further has a longitudinally-oriented and generally T-shaped track channel that extends along said longitudinal axis of said elongated, generally rectangular-parallelepiped-shaped, and open-ended body and opens into said open ends of said elongated, generally rectangular-parallelepiped-shaped, and open-ended body; said longitudinally-oriented and generally T-shaped track channel of said elongated, generally rectangular-parallelepiped-shaped, and open-ended body has a portion that opens into said generally rectangular-shaped rear face of said elongated and generally rectangular-parallelepiped-shaped body.

4. The handle as defined in claim 3, wherein each of said pair of post portions has a generally rectangular-parallelepiped-shaped body with a generally rectangular-shaped proximal face, a generally rectangular-shaped distal face, a longitudinal axis, and a centrally-and-longitudinally-disposed throughbore that extends along said longitudinal axis of said generally rectangular-parallelepiped-shaped body from said generally rectangular-shaped proximal face of said generally rectangular-parallelepiped-shaped body to said generally rectangular-shaped distal face of said generally rectangular-parallelepiped-shaped body and into which a respective one of said pair of mounting screws enters; said generally rectangular-parallelepiped-shaped body is divided laterally into a generally rectangular-parallelepiped-shaped main portion and a generally rectangular-parallelepiped-shaped head portion by a pair of laterally-oriented, oppositely aligned, and generally rectangular-parallelepiped-shaped grooves; said pair of laterally-oriented, opposingly aligned, and generally rectangular-parallelepiped-shaped grooves of said generally rectangular-parallelepiped-shaped body are in opposing alignment to each other and extend laterally across said generally rectangular-parallelepiped-shaped body in proximity to said generally rectangular-shaped distal face of said generally rectangular-parallelepiped-shaped body; said generally rectangular-parallelepiped-shaped head portion of said generally rectangular-parallelepiped-shaped body is slidably mounted in said longitudinally-oriented and generally T-shaped track channel of said elongated, generally rectangular-parallelepiped-shaped, and open-ended body of said handle portion.

5. The handle as defined in claim 3, wherein each of said pair of post portions has a generally T-shaped body with a generally rectangular-shaped proximal face, a generally rectangular-shaped distal face, a longitudinal axis, and a centrally-and-longitudinally-disposed throughbore that extends along said longitudinal axis of said generally T-shaped body from said generally rectangular-shaped proximal face of said generally T-shaped body to said generally rectangular-shaped distal face of said generally T-shaped body and into which a respective one of said pair of mounting screws enters; said generally T-shaped body has a generally rectangular-parallelepiped-shaped main portion with an end and a coaxially-disposed, laterally-outwardly-extending, and generally rectangular-parallelepiped-shaped head portion that is coaxial with, and extends laterally outwardly from, said end of said generally rectangular-parallelepiped-shaped main portion of said generally T-shaped body; said coaxially-disposed, laterally-outwardly-extending, and generally rectangular-parallelepiped-shaped head portion of said generally T-shaped body is slidably mounted in said longitudinally-oriented and generally T-shaped track channel of said elongated, generally rectangular-parallelepiped-shaped, and open-ended body of said handle portion.

6. The handle as defined in claim 3, wherein each of said pair of post portions has a generally T-shaped body with a generally circular-shaped proximal face, a generally rectangular-shaped distal face, a longitudinal axis, and a centrally-and-longitudinally-disposed throughbore that extends along said longitudinal axis of said generally T-shaped body from said generally circular-shaped proximal face of said generally T-shaped body to said generally rectangular-shaped distal face of said generally T-shaped body and into which a respective one of said pair of mounting screws enters; said generally T-shaped body has a generally cylindrically-shaped main portion with an end and a coaxially-disposed, laterally-outwardly-extending, and generally rectangular-parallelepiped-shaped head portion that is coaxial with, and extends laterally outwardly from, said end of said generally cylindrically-shaped main portion of said generally T-shaped body; said coaxially-disposed, laterally-outwardly-extending, and generally rectangular-parallelepiped-shaped head portion of said generally T-shaped body is slidably mounted in said longitudinally-oriented and generally T-shaped track channel of said elongated, generally rectangular-parallelepiped-shaped, and open-ended body of said handle portion.

7. The handle as defined in claim 3, wherein each of said pair of post portions has a generally T-shaped body with a generally circular-shaped proximal face, a generally circular-shaped distal face, a longitudinal axis, and a centrally-and-longitudinally-disposed throughbore that extends along said longitudinal axis of said generally T-shaped body from said generally circular-shaped proximal face of said generally T-shaped body to said generally circular-shaped distal face of said generally T-shaped body and into which a respective one of said pair of mounting screws enters; said generally T-shaped body has a generally cylindrically-shaped main portion with an end, and a coaxially-disposed, laterally-outwardly-extending, and generally cylindrically-shaped head portion that is coaxial with, and extends laterally outwardly from, said end of said generally cylindrically-shaped main portion of said generally T-shaped body; said coaxially-disposed, laterally-outwardly-extending, and generally cylindrically-shaped head portion of said generally T-shaped body is slidably mounted in said longitudinally-oriented and generally T-shaped track channel of said elongated, generally rectangular-parallelepiped-shaped, and open-ended body of said handle portion.

8. The handle as defined in claim 3, wherein each of said pair of post portions has a generally T-shaped body with a generally rectangular-shaped proximal face, a generally circular-shaped distal face, a longitudinal axis, and a centrally-and-longitudinally-disposed throughbore that extends along said longitudinal axis of said generally T-shaped body from said generally rectangular-shaped proximal face of said generally T-shaped body to said generally circular-shaped distal face of said generally T-shaped body and into which a respective one of said pair of mounting screws enters; said generally T-shaped body has a generally rectangular-parallelepiped-shaped main portion with an end and a coaxially-disposed, laterally-outwardly-extending, and generally cylindrically-shaped head portion that is coaxial with, and extends laterally outwardly from, said end of said generally rectangular-parallelepiped-shaped main portion of said generally T-shaped body; said coaxially-disposed, laterally-outwardly-extending, and generally cylindrically-shaped head portion of said generally T-shaped body is slidably mounted in said longitudinally-oriented and generally T-shaped track channel of said elongated, generally rectangular-parallelepiped-shaped, and open-ended body of said handle portion.

9. The handle as defined in claim 3, wherein each of said pair of post portions has a generally cylindrically-shaped body with a generally circular-shaped proximal face, a generally circular-shaped distal face, a longitudinal axis, and a centrally-and-longitudinally-disposed throughbore that extends along said longitudinal axis of said generally cylindrically-shaped body from said generally circular-shaped proximal face of said generally cylindrically-shaped body to said generally circular-shaped distal face of said generally cylindrically-shaped body and into which a respective one of said pair of mounting screws enters; said generally cylindrically-shaped body is divided laterally into a generally cylindrically-shaped main portion and a coaxially-disposed and generally cylindrically-shaped head portion by a circumferencially-disposed annular groove; said coaxially-disposed and generally cylindrically-shaped head portion of said generally cylindrically-shaped body is coaxial with said generally cylindrically-shaped main portion of said generally cylindrically-shaped body; said circumferencially-disposed annular groove of said generally cylindrically-shaped body extends circumferencially around said generally cylindrically-shaped body in proximity to said generally circular-shaped distal face of said generally cylindrically-shaped body; said coaxially-disposed and generally cylindrically-shaped head portion of said generally cylindrically-shaped body is slidably mounted in said longitudinally-oriented and generally T-shaped track channel of said elongated, generally rectangular-parallelepiped-shaped, and open-ended body of said handle portion.

10. The handle as defined in claim 3, wherein each of said pair of post portions has a body with a circular-shaped proximal face, a generally rectangular-shaped distal face, a longitudinal axis, and a centrally-and-longitudinally-disposed throughbore that extends along said longitudinal axis of said body from said generally circular-shaped proximal face of said body to said generally rectangular-shaped distal face of said body and into which a respective one of said pair of mounting screws enters; said body is divided laterally into a generally cylindrically-shaped main portion and a coaxially-disposed and generally rectangular-parallelepiped-shaped head portion by a circumferencially-disposed annular groove; said coaxially-disposed and generally rectangular-parallelepiped-shaped head portion of said body is coaxial with said generally cylindrically-shaped main portion of said body; said circumferencially-disposed annular groove of said body extends circumferencially around said body in proximity to said generally rectangular-shaped distal face of said body; said coaxially-disposed and generally rectangular-parallelepiped shaped head portion of said body is slidably mounted in said longitudinally-oriented and generally T-shaped track channel of said elongated, generally rectangular-parallelepiped-shaped, and open-ended body of said handle portion.

11. The handle as defined in claim 3, wherein each of said pair of post portions has a body with a generally rectangular-shaped proximal face, a generally circular-shaped distal face, a longitudinal axis, and a centrally-and-longitudinally-disposed throughbore that extends along said longitudinal axis of said body from said generally rectangular-shaped proximal face of said body to said generally circular-shaped distal face of said body and into which a respective one of said pair of mounting screws enters; said body is divided laterally into a generally rectangular-parallelepiped-shaped main portion and a coaxially-disposed and generally cylindrically-shaped head portion by a circumferentially-disposed annular groove; said coaxially-disposed and generally cylindrically-shaped head portion of said body is coaxial with said generally rectangular-parallelepiped-shaped main portion of said body; said circumferentially-disposed annular groove of said body extends circumferentially around said body in proximity to said generally circular-shaped distal face of said body; said coaxially-disposed and generally cylindrically-shaped head portion of said body is slidably mounted in said longitudinally-oriented and generally T-shaped track channel of said elongated, generally rectangular-parallelepiped-shaped, and open-ended body of said handle portion.

12. The handle as defined in claim 3; further comprising a length adjustable and generally T-shaped filler element insertably mounted in said longitudinally-oriented and generally T-shaped track channel of said elongated, generally rectangular-parallelepiped-shaped, and open-ended body of said handle portion; said length adjustable and generally T-shaped filler element having an elongated and generally T-shaped body being length adjustable by a plurality of laterally-oriented and spaced-apart break slots, so that said longitudinally-oriented and generally T-shaped track channel of said elongated, generally rectangular-parallelepiped-shaped, and open-ended body of said handle portion can be filled between said pair of post portions.

13. The handle as defined in claim 1, wherein said handle portion has an elongated, generally cylindrically-shaped, and open-ended body with open ends, a generally arcuate-shaped rear face, and a longitudinal axis; said elongated, generally cylindrically-shaped, and open-ended body further has a longitudinally-oriented and generally T-shaped track channel that extends along said longitudinal axis of said elongated, generally cylindrically-shaped, and open-ended body and opens into said open ends of said elongated, generally cylindrically-shaped, and open-ended body; said longitudinally-oriented and generally T-shaped track channel of said elongated, generally cylindrically-shaped, and open-ended body has a portion that opens into said generally arcuate-shaped rear face of said elongated and generally cylindrically-shaped body.

14. The handle as defined in claim 13, wherein each of said pair of post portions has a generally rectangular-parallelepiped-shaped body with a generally rectangular-shaped proximal face, a generally rectangular-shaped distal face, a longitudinal axis, and a centrally-and-longitudinally-disposed throughbore that extends along said longitudinal axis of said generally rectangular-parallelepiped-shaped body from said generally rectangular-shaped proximal face of said generally rectangular-parallelepiped-shaped body to said generally rectangular-shaped distal face of said generally rectangular-parallelepiped-shaped body and into which a respective one of said pair of mounting screws enters; said generally rectangular-parallelepiped-shaped body is divided laterally into a generally rectangular-parallelepiped-shaped main portion and a generally rectangular-parallelepiped-shaped head portion by a pair of laterally-oriented, opposingly aligned, and generally rectangular-parallelepiped-shaped grooves; said pair of laterally-oriented, opposingly aligned, and generally rectangular-parallelepiped-shaped grooves of said generally rectangular-parallelepiped-shaped body are in opposing alignment to each other and extend laterally across said generally rectangular-parallelepiped-shaped body in proximity to said generally rectangular-shaped distal face of said generally rectangular-parallelepiped-shaped body; said generally rectangular-parallelepiped-shaped head portion of said generally rectangular-parallelepiped-shaped body is slidably mounted in said longitudinally-oriented and generally T-shaped track channel of said elongated, generally cylindrically-shaped, and open-ended body of said handle portion.

15. The handle as defined in claim 13, wherein each of said pair of post portions has a generally T-shaped body with a generally rectangular-shaped proximal face, a generally rectangular-shaped distal face, a longitudinal axis, and a centrally-and-longitudinally-disposed throughbore that extends along said longitudinal axis of said generally T-shaped body from said generally rectangular-shaped proximal face of said generally T-shaped body to said generally rectangular-shaped distal face of said generally T-shaped body and into which a respective one of said pair of mounting screws enters; said generally T-shaped body has a generally rectangular-parallelepiped-shaped main portion with an end and a coaxially-disposed, laterally-outwardly-extending, and generally rectangular-parallelepiped-shaped head portion that is coaxial with, and extends laterally outwardly from, said end of said generally rectangular-parallelepiped-shaped main portion of said generally T-shaped body; said coaxially-disposed, laterally-outwardly-extending, and generally rectangular-parallelepiped-shaped head portion of said generally T-shaped body is slidably mounted in said longitudinally-oriented and generally T-shaped track channel of said elongated, generally cylindrically-shaped, and open-ended body of said handle portion.

16. The handle as defined in claim 13, wherein each of said pair of post portions has a generally T-shaped body with a generally circular-shaped proximal face, a generally rectangular-shaped distal face, a longitudinal axis, and a centrally-and-longitudinally-disposed throughbore that extends along said longitudinal axis of said generally T-shaped body from said generally circular-shaped proximal face of said generally T-shaped body to said generally rectangular-shaped distal face of said generally T-shaped body and into which a respective one of said pair of mounting screws enters; said generally T-shaped body has a generally cylindrically-shaped main portion with an end and a coaxially-disposed, laterally-outwardly-extending, and generally rectangular-parallelepiped-shaped head portion that is coaxial with, and extends laterally outwardly from, said end of said generally cylindrically-shaped main portion of said generally T-shaped body; said coaxially-disposed, laterally-outwardly-extending, and generally rectangular-parallelepiped-shaped head portion of said generally T-shaped body is slidably mounted in said longitudinally-oriented and generally T-shaped track channel of said elongated, generally cylindrically-shaped, and open-ended body of said handle portion.

17. The handle as defined in claim 13, wherein each of said pair of post portions has a generally T-shaped body with a generally circular-shaped proximal face, a generally circular-shaped distal face, a longitudinal axis, and a centrally-and-longitudinally-disposed throughbore that extends along said longitudinal axis of said generally T-shaped body from said generally circular-shaped proximal face of said generally T-shaped body to said generally circular-shaped distal face of said generally T-shaped body and into which a respective one of said pair of mounting screws enters; said generally T-shaped body has a generally cylindrically-shaped main portion with an end and a coaxially-disposed, laterally-outwardly-extending, and generally cylindrically-shaped head portion that is coaxial with, and extends laterally outwardly from, said end of said generally cylindrically-shaped main portion of said generally T-shaped body; said coaxially-disposed, laterally-outwardly-extending, and generally cylindrically-shaped head portion of said generally T-shaped body is slidably mounted in said longitudinally-oriented and generally T-shaped track channel of said elongated, generally cylindrically-shaped, and open-ended body of said handle portion.

18. The handle as defined in claim 13, wherein each of said pair of post portions has a generally T-shaped body with a generally rectangular-shaped proximal face, a generally circular-shaped distal face, a longitudinal axis, and a centrally-and-longitudinally-disposed throughbore that extends along said longitudinal axis of said generally T-shaped body from said generally rectangular-shaped proximal face of said generally T-shaped body to said generally circular-shaped distal face of said generally T-shaped body and into which a respective one of said pair of mounting screws enters; said generally T-shaped body has a generally rectangular-parallelepiped-shaped main portion with an end, and a coaxially-disposed, laterally-outwardly-extending, and generally cylindrically-shaped head portion that is coaxial with, and extends laterally outwardly from, said end of said generally rectangular-parallelepiped-shaped main portion of said generally T-shaped body; said coaxially-disposed, laterally-outwardly-extending, and generally cylindrically-shaped head portion of said generally T-shaped body is slidably mounted in said longitudinally-oriented and generally T-shaped track channel of said elongated, generally cylindrically-shaped, and open-ended body of said handle portion.

19. The handle as defined in claim 13, wherein each of said pair of post portions has a generally cylindrically-shaped body with a generally circular-shaped proximal face, a generally circular-shaped distal face, a longitudinal axis, and a centrally-and-longitudinally-disposed throughbore that extends along said longitudinal axis of said generally cylindrically-shaped body from said generally circular-shaped proximal face of said generally cylindrically-shaped body to said generally circular-shaped distal face of said generally cylindrically-shaped body and into which a respective one of said pair of mounting screws enters; said generally cylindrically-shaped body is divided laterally into a generally cylindrically-shaped main portion and a coaxially-disposed and generally cylindrically-shaped head portion by a circumferencially-disposed annular groove; said coaxially-disposed and generally cylindrically-shaped head portion of said generally cylindrically-shaped body is coaxial with said generally cylindrically-shaped main portion of said generally cylindrically-shaped body; said circumferencially-disposed annular groove of said generally cylindrically-shaped body extends circumferencially around said generally cylindrically-shaped body in proximity to said generally circular-shaped distal face of said generally cylindrically-shaped body; said coaxially-disposed and generally cylindrically-shaped head portion of said generally cylindrically-shaped body is slidably mounted in said longitudinally-oriented and generally T-shaped track channel of said elongated, generally cylindrically-shaped, and open-ended body of said handle portion.

20. The handle as defined in claim 13, wherein each of said pair of post portions has a body with a circular-shaped proximal face, a generally rectangular-shaped distal face, a longitudinal axis, and a centrally-and-longitudinally-disposed throughbore that extends along said longitudinal axis of said body from said generally circular-shaped proximal face of said body to said generally rectangular-shaped distal face of said body and into which a respective one of said pair of mounting screws enters; said body is divided laterally into a generally cylindrically-shaped main portion and a coaxially-disposed and generally rectangular-parallelepiped-shaped head portion by a circumferentially-disposed annular groove; said coaxially-disposed and generally rectangular-parallelepiped-shaped head portion of said body is coaxial with said generally cylindrically-shaped main portion of said body; said circumferentially-disposed annular groove of said body extends circumferentially around said body in proximity to said generally rectangular-shaped distal face of said body; said coaxially-disposed and generally rectangular-parallelepiped-shaped head portion of said body is slidably mounted in said longitudinally-oriented and generally T-shaped track channel of said elongated, generally cylindrically-shaped, and open-ended body of said handle portion.

21. The handle as defined in claim 13, wherein each of said pair of post portions has a body with a generally rectangular-shaped proximal face, a generally circular-shaped distal face, a longitudinal axis, and a centrally-and-longitudinally-disposed throughbore that extends along said longitudinal axis of said body from said generally rectangular-shaped proximal face of said body to said generally circular-shaped distal face of said body and into which a respective one of said pair of mounting screws enters; said body is divided laterally into a generally rectangular-parallelepiped-shaped main portion and a coaxially-disposed and generally cylindrically-shaped head portion by a circumferentially-disposed annular groove; said coaxially-disposed and generally cylindrically-shaped head portion of said body is coaxial with said generally rectangular-parallelepiped-shaped main portion of said body; said circumferentially-disposed annular groove of said body extends circumferentially around said body in proximity to said generally circular-shaped distal face of said body; said coaxially-disposed and generally cylindrically-shaped head portion of said body is slidably mounted in said longitudinally-oriented and generally T-shaped track channel of said elongated, generally cylindrically-shaped, and open-ended body of said handle portion.

22. The handle as defined in claim 13; further comprising a length adjustable and generally T-shaped filler insertably mountable in said longitudinally-oriented and generally T-shaped track channel of said elongated, generally cylindrically-shaped, and open-ended body of said handle portion; said length adjustable and generally T-shaped filler having an elongated and generally T-shaped body being length adjustable by a plurality of laterally-oriented and spaced-apart break slots, so that said longitudinally-oriented and generally T-shaped track channel of said elongated, generally cylindrically-shaped, and open-ended body of said handle portion can be filled between said pair of post portions.

23. The handle as defined in claim 1; further comprising a generally cylindrically-shaped filler plug being insertable in each of said pair of post portions and cooperating with a respective one of said free ends of said pair of mounting screws, so that said universal drawer handle can be used with conventional drawer fronts of varying thicknesses.

24. The handle as defined in claim 23, wherein said generally cylindrically-shaped filler plug is selected from the group consisting of rubber, plastic, and metal.

25. A method of using a universal drawer handle to replace a handle of any size on a drawer front of any thickness, comprising the steps of:

a) passing a pair of mounting screws of said universal drawer handle through a pair of conventional handle mounting holes in a conventional drawer front of a conventional drawer from inside the conventional drawer;

b) threading each of a pair of post portions of said universal drawer handle onto a respective one of said pair of mounting screws with each of said pair of mounting screws threadably engaging a centrally-and-longitudinally-disposed throughbore of a respective one of said pair of post portions;

c) sliding a handle portion of said universal drawer handle onto said pair of post portions with a head portion of each of said pair of post portions sliding in a longitudinally-oriented and generally T-shaped track channel of said handle portion, so that said handle portion is free to slide relative to said pair of post portions and adjust for different spacings between different pairs of conventional handle mounting holes of different conventional drawer fronts of different conventional drawers so as to allow said universal drawer handle to be used to replace different sized drawer handles;

d) positioning said handle portion relative to said pair of post portions; and e) tightening said pair of mounting screws until a pair of free ends of said pair of mounting screws exert a force on a wall of said longitudinally-oriented and generally T-shaped track channel of said handle portion, so that the handle portion is secured to the pair of post portions and prevented from lateral movement relative thereto while the pair of post portions are secured between the conventional drawer front of the conventional drawer and the handle portion.

26. The method as defined in claim 25; further comprising the steps of adjusting the length of a resilient, length adjustable, and generally T-shaped track filler of said universal drawer handle to the distance between said pair of post portions by removing an appropriate portion of said resilient, length adjustable, and generally T-shaped track filler via the use of an appropriate one of a plurality of laterally-oriented and spaced-apart break slots disposed laterally on said resilient, length adjustable, and generally T-shaped track filler; and sliding said properly lengthed resilient, length adjustable, and generally T-shaped track filler into said longitudinally-oriented and generally T-shaped track channle of said handle portion after said handle portion has been of post portions, but before said handle portion is slid onto another post portion of said pair of post portions to a position where said pair of post portions straddle said properly lengthed resilient, length adjustable, and generally T-shaped track filler, so that the space between said pair of post portions is filled.

27. The method as defined in claim 25; further comprising the step of inserting a filler plug of said universal drawer handle handle into said centrally-and-longitudinally-disposed throughbore of each of said pair of post portions prior to said threading step, so that varying thicknesses of different conventional drawer fronts of different conventional drawers can be compensated for.

* * * * *